United States Patent [19]

Marukawa et al.

[11] Patent Number: 4,577,626

[45] Date of Patent: Mar. 25, 1986

[54] MASSAGER

[75] Inventors: Toshio Marukawa; Haruki Nakao; Toshio Mikiya, all of Tokyo, Japan

[73] Assignee: Nikki Co., Ltd., Tokyo, Japan

[21] Appl. No.: 658,465

[22] Filed: Oct. 9, 1984

Related U.S. Application Data

[63] Continuation of Ser. No. 233,079, Feb. 9, 1981, abandoned.

[51] Int. Cl.[4] ..... A61H 7/00

[52] U.S. Cl. ..... 128/64; 128/40; 137/625.11; 137/625.21

[58] Field of Search ..... 128/38–40, 128/24, 50, 53, 64, 65; 417/417; 137/625.11, 625.21, 625.46

[56] References Cited

U.S. PATENT DOCUMENTS

| | | | |
|---|---|---|---|
| 1,978,866 | 10/1934 | König | 417/417 |
| 2,297,025 | 9/1942 | Russell | 417/417 |
| 3,253,678 | 4/1966 | Osmond | 137/625.11 X |
| 3,465,749 | 9/1969 | Moreland et al. | 128/24 R |
| 3,587,567 | 6/1971 | Schiff | 128/64 |
| 3,590,815 | 7/1971 | Schiff | 128/64 |
| 3,713,462 | 1/1973 | Bushee | 137/625.11 |
| 4,013,069 | 3/1977 | Hasty | 128/24 R |
| 4,021,151 | 5/1977 | Barthalon | 417/417 |
| 4,193,149 | 3/1980 | Welch | 128/38 |

FOREIGN PATENT DOCUMENTS

| | | | |
|---|---|---|---|
| 1027268 | 5/1953 | France . | |
| 1464774 | 11/1965 | France | 128/40 |
| 2079964 | 12/1971 | France . | |
| 48-25563 | 7/1973 | Japan . | |
| 51-41794 | 11/1976 | Japan . | |
| 52-53190 | 4/1977 | Japan . | |
| 53-17673 | 5/1978 | Japan . | |

*Primary Examiner*—Richard J. Apley
*Assistant Examiner*—David J. Brown
*Attorney, Agent, or Firm*—Wenderoth, Lind & Ponack

[57] ABSTRACT

A massager is composed of a linear compressor having a piston reciprocated by force of electromagnetic attraction to produce compressed air at a safe pressure with a relatively small difference between the rated pressure and the maximum pressure, a distributor for allowing the compressed air fed from the compressor to be selectively discharged therefrom and a bag having a plurality of air tight sections which are successively expanded by receiving the compressed air fed from the distributor.

6 Claims, 13 Drawing Figures

MASSAGER

This application is a continuation of now abandoned application Ser. No. 233,079, filed Feb. 9, 1981.

BACKGROUND OF THE INVENTION

This invention relates to a massager which utilizes compressed air at a safe pressure and has a simple structure and easy operation.

As a device for effectively giving a pressure massage to the skin or muscles of a subject, there has existed a pressure-fluid massager provided with a bag means of rubber or the like, which is wound around a portion to be treated on the subject and expanded by supplying thereto a pressure fluid such as compressed air to exert massaging pressure upon the portion to be treated, thereby massaging the subject. In the massager of this type, to improve the massaging effect, the bag means is partitioned off into air-tight sections so that a pressure fluid can successively be fed into the air-tight sections by use of a distributing valve to give the massaging pressure to successive parts of the portion to be treated on the subject in consequence of the expansion of the bag means. Concrete examples are described in Japanese patent publication No. 41794/1976 and Japanese utility model publication No. 17673/1978.

The former item is distinguished by having four electromagnetic switching valves corresponding to four massaging bags, which valves are individually controlled by means of a rotary switch having of four contacts so as to successively supply compressed air to the respective bags. In the latter item, a supply of compressed air to four massaging bags is carried out by use of a set of four pilot valves for delivering the compressed air to the respective bags and another set of four transferring valves for controlling the aforesaid pilot valves. Such a complex mechanism depending on a complicated pipe arrangement is one serious drawback of these conventional massagers.

Besides, the massagers of this sort including the foregoing massagers make use of a rotary compressor of any type or a diaphragm-compressor as a means for producing pressure fluid of air or liquid. The application of the massager utilizing such a compressor to a living body has not been practical from the standpoint of safety inasmuch as the pressure difference between the rated pressure and the maximum pressure of the compressor is relatively large, thereby entailing the possibility of the pressure produced by the compressor becoming too high. To cope with such a disadvantage, the conventional massager has been provided with relief valves and regulator valves to ensure a safe pressure for massaging the subject, but involving the dangers of an accident to the valves.

SUMMARY OF THE INVENTION

An object of this invention is to provide a safe massager designed for domestic use and medical use and having a simple structure and which is handy, wherein safe pressure fluid is effectively supplied to each of the massaging bags.

In order to achieve the aforesaid object according to this invention, there is provided a massager which comprises an electromagnetic linear compressor for producing constant pressure compressed air, which compressor has an electromagnet means excited intermittently by an alternating current and a piston driven by virtue of magnetism generated by the electromagnet means; a distributing means for selectively distributing the compressed air fed from the compressor by use of a rotary member; and a bag means having one or more air-tight sections which are expanded by means of the compressed air fed from the compressor through the distributing means.

Since the piston in the compressor described above is reciprocated by the force of magnetic attraction generated by the electromagnet means, the pressure difference between the rated pressure and the maximum pressure can be kept relatively small and, therefore, the massager using this compressor is safely applicable to a living body. The distributing means is mainly composed of simple structures including a stationary member and the rotary member having a recess for selectively connecting the admission passage of the stationary member with one of the exhaust ports of the same. This compressor and the distributing means have a simple structure so that the massager can be made small and handy so as to be especially suitable for a household use.

The other objects and characteristic features of the present invention will become apparent from the detailed description to be given hereinafter with reference to the accompanying drawings.

DESCRIPTION OF THE PREFERRED EMBODIMENTS

This invention relates to a massager which effectively gives a subject a pressure massage by expanding a bag means wound around the subject by supplying compressed air to the bag means.

Figure 1:
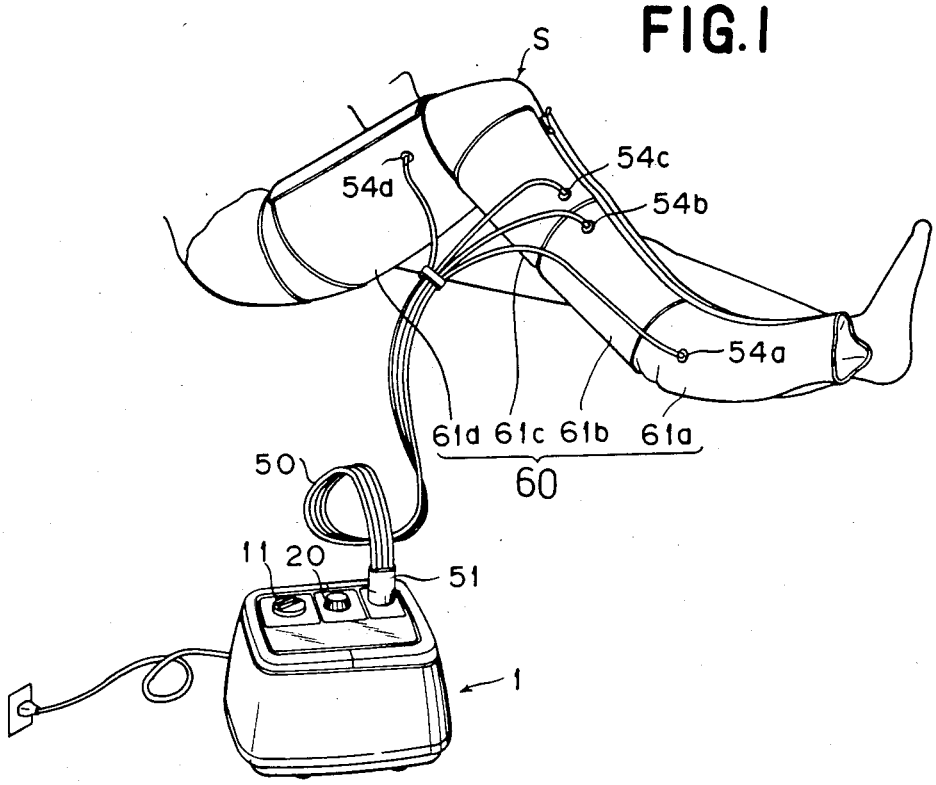
FIG. 1 is an explanatory perspective view illustrating the operation principle of one preferred embodiment of the massager according to the present invention.

FIG. 1 illustrates the massager according to the present invention arranged for massaging the leg the subject S. The massager is mainly composed of a controller 1 for producing and discharging compressed air, one or more bag means 60 which are expanded by means of the compressed air produced by the controller 1 to exert massaging pressure upon the leg of the subject S, and an air-delivering means 50 for feeding the compressed air from the controller 1 to the bag means 60. In order to heighten the massaging effect according to the foregoing massager in this embodiment, two bag means are used, one having three air-tight sections 61*a*, 61*b* and 61*c* and the other having one air-tight section 61*d*, and the compressed air is successively supplied to the respective air-tight sections. As described hereinbefore, the conventional massager requires a plurality of separate valve means for controlling the supply of compressed air to the respective air-tight sections of the bag means. However, in this invention, compressed air constantly at a safe pressure can be effectively fed to the respective air-tight sections by a single distributing means having a simple structure.

Figure 3:
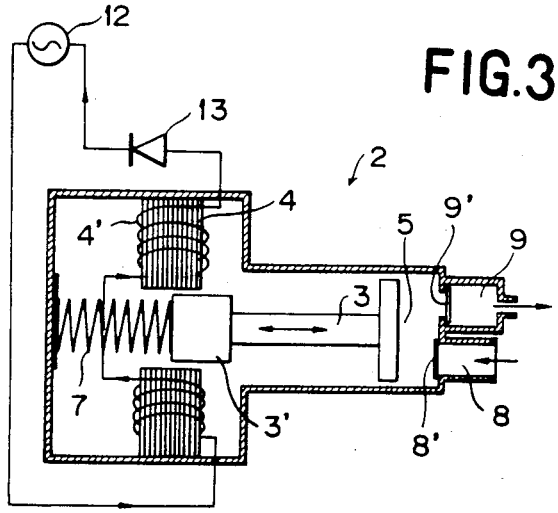
FIG. 3 is a schematic diagram of the compressor used in the present invention.
Figure 2:
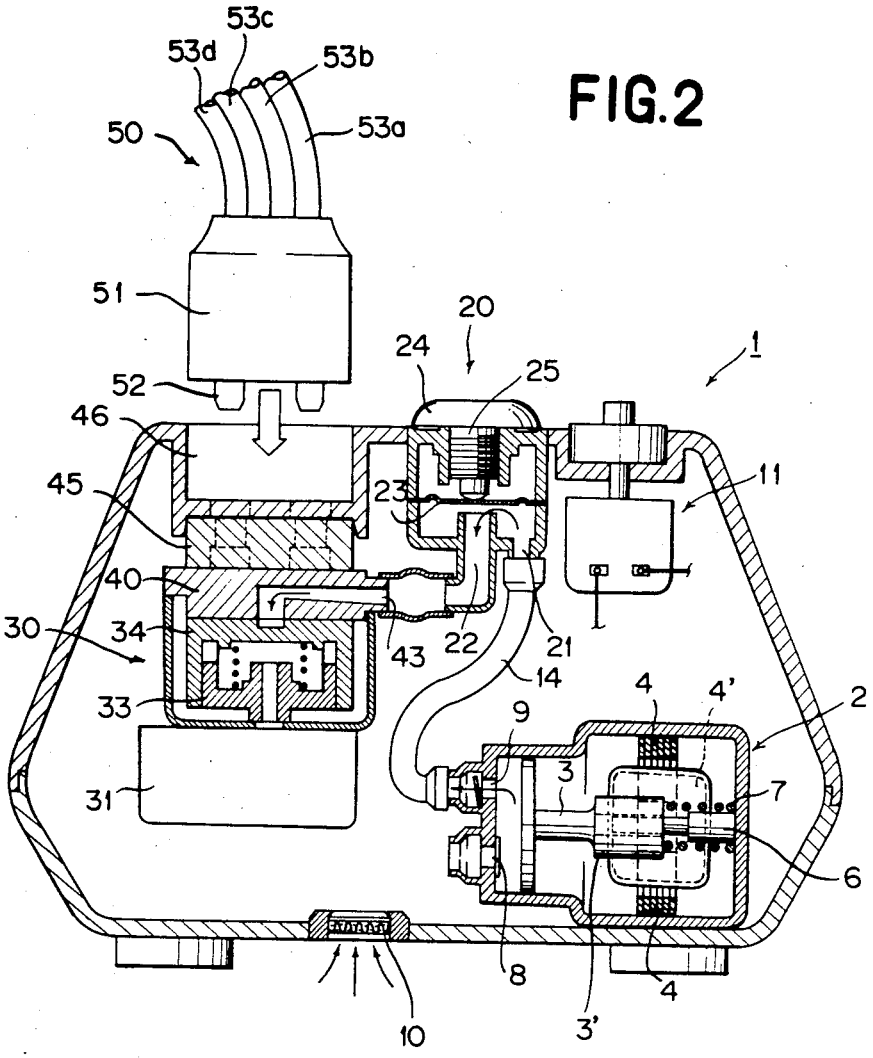
FIG. 2 is a sectioned side view of the controller used in the present invention.

The controller is, as illustrated in FIG. 2, mainly composed of an electromagnetic linear compressor 2 for producing compressed air, a regulator 20 for regulating the flow rate of the compressed air delivered from the compressor 2 and a rotary distributing means 30 for selectively forwarding to each air-tight section of the bag means 60 the compressed air fed from the regulator 20. The controller 1 is further provided with a timer 11 for adjusting the time required for massaging. The linear compressor 2 is, as also illustrated in FIG. 3, composed of an electromagnet means 4 having two spaced opposed poles around which induction coils 4' are wound, and is fixedly mounted on the housing of the compressor 2, a piston 3 provided with an armature 3' to be attracted to a position between the poles by force of magnetic attraction generated by the electromagnet means 4, a coil spring urging the piston 3 toward a compression chamber 5, an intake port 8 provided with a check valve 8' and a discharge port 9 provided with a check valve 9'. The electromagnet means 4 intermittently generates magnetism by applying to the induction coil 4' thereof an alternating current from the power source 12 to intermittently attract the armature 3' of the piston 3 to a position between the poles, thereby causing the piston to be moved toward the electromagnet means 4. When the flow of electric current in the coil 4' of the electromagnet means 4 is stopped, the piston 3 is moved toward chamber 5 by the force of the coil spring 7. As a consequence of the supply of an alternating current to the electromagnet means 4, the piston 3 is reciprocally moved at a frequency in proportion to the frequency of the alternating current. The reciprocating motion of the piston is securely carried out by the aid of a guide rod 6 fixedly disposed on the body of the compressor. The check valve 8' provided on the intake port 8 functions to permit air introduced into the interior of the controller 1 through a filter 10 to flow into the compression chamber 5, and on the other hand, the check valve 9' provided on the discharge port 9 functions to permit the air introduced into the compressed chamber 5 through the intake port 8 to be discharged from the compression chamber 5. That is, air is fed into the compression chamber 5 by way of the filter 10 and the intake port 8 and is compressed and discharged through the discharge port 9, during the reciprocating motion of the piston 3.

Figure 4:
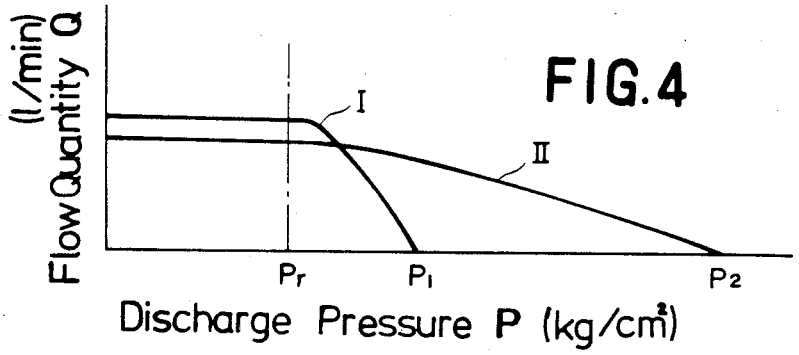
FIG. 4 is a characteristic diagram showing the relationship between the flow quantity and the discharge pressure in the present and conventional compressors.

The electromagnetic linear compressor 2 of the aforesaid structure has the following advantage. As shown by the curve I in FIG. 4, the discharge pressure P produced by the compressor being used in this invention is stabilized at a relatively low pressure $P_1$ when the pressure exceeds the rated pressure $P_r$ of the compressor and then the flow quantity Q is reduced. That is, the difference between the maximum pressure which can be produced by the present linear compressor and the rated pressure thereof is relatively small. However, in a conventional rotary compressor, for example, as shown by the curve II in FIG. 4, the discharge pressure P rises further when the pressure exceeds the rated pressure $P_r$ thereby reducing the flow quantity Q and, consequently, the pressure is stabilized at a considerably high pressure $P_2$. From the disclosure thus far made, it can be concluded that the present massager using the linear compressor is very safely applicable to a living body in comparison with the conventional massager using a common rotary compressor.

Figure 5:
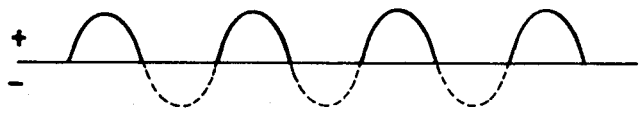
FIG. 5 illustrates the waveform of an electric current rectified by use of a diode.
Figure 6A:
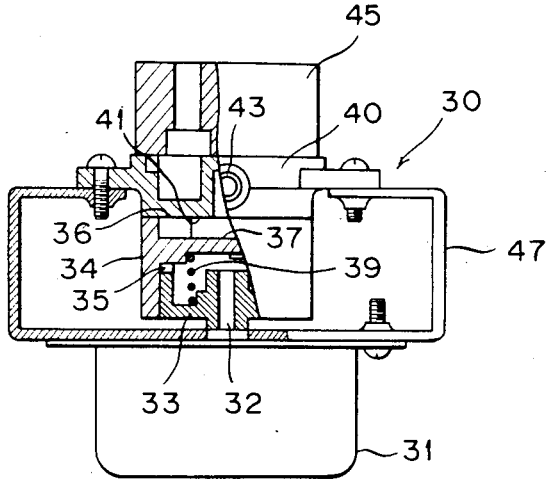
FIGS. 6A and 6B are a partially sectioned side view and a plan view of the distributing means of the present invention.
Figure 6B:
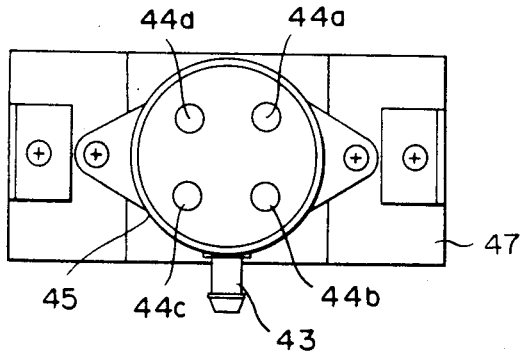
Figure 7A:
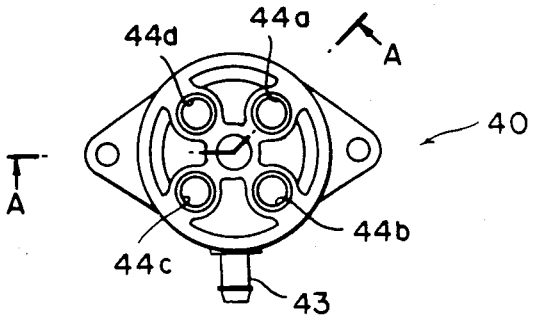
FIGS. 7A, 7B and 7C are a plan view and sectioned side views of the stationary member in the distributing means of the present invention.

In this embodiment, a normal alternating current (full-wave current) may be applied to the compressor 2. A half-wave rectified current as illustrated in FIG. 5, which is obtained by passing an alternating current through a rectifier (diode) 13 as illustrated in FIG. 3 may also be applied to the compressor 2. As a result of applying a half-wave rectified current to the compressor, the electromagnet means 4 generates intermittent magnetism so that the piston 3 is urged back toward the compression chamber 5 by the force of the spring 7 when no voltage is generated on the negative side in a current waveform as illustrated in FIG. 5. Consequently, the piston is readily reciprocated in proportion to the frequency of the alternating current thus applied to produce pressure suitable for massaging the subject.

The compressed air discharged from the compressor 2 is fed to the flow rate regulator 20 through a feeding tube 14. The regulator 20 has a diaphragm 23 which is forced downwardly by a threaded spindle 25 movable axially by use of a knob handle 24. The regulator 20 is further provided with an outlet nozzle 22 on the opposite side of the diaphragm 23 from the threaded spindle 25 so as to leave a small gap between the nozzle 22 and the diaphragm 23. The compressed air produced by the compressor 2 is fed into the regulator 20 from an inlet port 21 and discharged from the outlet nozzle 22 through the small gap between the nozzle 22 and the diaphragm 23. When the threaded spindle 25 is moved downwardly, the gap between the nozzle and the diaphragm further narrows to reduce the amount of the compressed air discharged. In such a way, the massaging pressure to be exerted on the subject can be adjusted.

Referring to FIGS. 2 and 6 through 8, there is shown the rotary air distributing means 30 for selectively discharging the compressed air fed from the regulator 20 to the respective air tight sections of the bag means 60. The distributing means 30 is mainly composed of a motor 31, a rotary disc 33 fixed on a motor shaft 32 of the motor, a rotary member 34 with notches 35 which are engaged with the peripheral edge of the rotary disc 33 to transmit to the rotary member 34 the rotational motion of the rotary disc 33 being rotated by means of the motor 31, and a stationary member 40 the lower surface 41 of which is urged into close contact with the upper surface 36 of the rotary member by the force of a spring 39 urging the rotary member 34 upwardly.

The stationary member 40 is fixed on a frame 47 mounted on the motor 31 and provided in the center portion of the lower surface thereof with an admission passage 42. The compressed air fed from the compressor 2 through the regulator 20 is introduced into the admission passage 42 via a through hole 43. Around the admission passage 42, there are provided a number of exhaust ports **44*a*, 44*b*, 44*c* and 44*d* equal to the number of the air-tight sections 61*a*–61*d*** of the bag means and at an equal distance from one another.

Figure 8A:
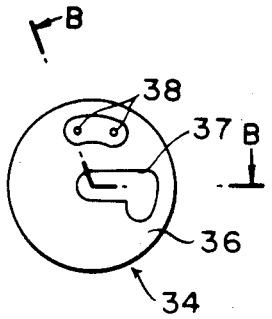
FIGS. 8A, 8B and 8C are a bottom view, a tops plan view and a sectioned side view of the rotary member in the distributing means of the present invention.
Figure 7B:
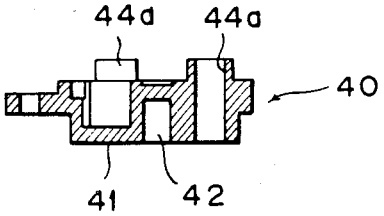
Figure 8B:
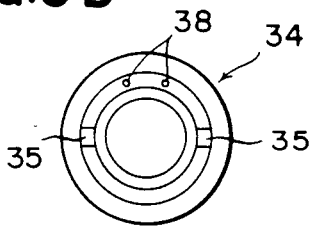
Figure 7C:
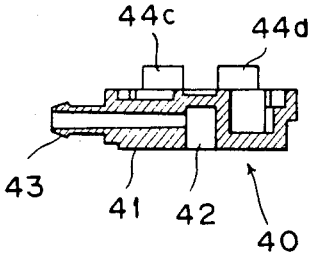
Figure 8C:
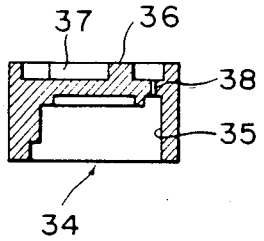

The rotary member 34, as illustrated in FIG. 8, has on its upper surface 36 a connecting recess 37 for communicating the admission passage 42 with the respective exhaust ports **44*a*–44*d* of the stationary member 40 one at a time, and one or more throttle holes 38 for allowing escape of the compressed air introduced into the air-tight sections of the bag means, which throttle holes are placed behind the connecting recess in relation to the rotary direction of the rotary member 34**.

When the motor 31 is driven while the rotary member 34 and the stationary member 40 are engaged with each other, the compressed air fed via the through hole 43 and the admission passage 42 is successively discharged through the exhaust ports 44*a*–44*d*, and consequently, the compressed air is supplied to the corresponding section of the bag means by the medium of an air-delivering means 50. Through the throttle hole 38 communicated with one of the exhaust ports 44*a*–44*d*, the compressed air supplied to the corresponding section of the bag means 60 is discharged and then it is released to the outside of the distributing means 30 through the narrow gap between the rotary disc 33 and the rotary member 34. This air-delivering means 50 is composed of four pipes 53*a*, 53*b*, 53*c* and 53*d* for connecting the respective exhaust ports 44*a*–44*d* with the corresponding sections 61*a*–61*d*, respectively. A plug 51 capable of being fitted in a socket 46 of the controller 1 is provided at one end of the air-delivering means 50 and the plug terminals 52 thereof are detachably inserted into a block 45 to communicate with the exhaust ports 44*a*–44*d*. At the other end of the air-delivering means 50, there are provided a plurality of couplers 54*a*, 54*b*, 54*c* and 54*d* detachably connected with coupler-receptacles mounted on the respective sections 61*a*–61*d* of the bag means. FIG. 1 illustrates the apparatus during use, in which the controller 1 and the bag means 60 wound around the subject S are connected with each other by means of the air-delivering means 50. In this state, when the compressor 2 and the distributing means 30 are operated, compressed air is successively supplied to the respective sections of the bag means, thereby giving the massaging pressure to the subject S.

As is clear from the foregoing disclosure, the massager according to the present invention enjoys an advantage that massage can safely and reliably be carried out by use of the compressor which has a relatively small pressure difference between the rated pressure and the maximum output pressure and the simply constructed air distributing means. This massager which is composed of simple mechanisms and permits reduction in size is handy and can be used as a safe home appliance.

What is claimed is:

1. A massager comprising:

an electromagnetic linear compressor for producing compressed air and which has a compression chamber with an intake port and a discharge port, a piston slidably mounted within said compression chamber and movable in a direction into and a direction out of said compression chamber for compressing air therein and further having an armature thereon which is capable of being attracted by a magnetic force, a coil spring engaged with said piston for urging said piston in a direction into said compression chamber, and an electromagnet means adjacent the path of movement of said piston for generating a magnetic force when current is applied thereto and positioned for applying a magnetic force to said armature for moving said piston out of said compression chamber against the force of said coil spring;

distributing means having a stationary member having a central air admission passage opening out of one end thereof and connected with the discharge port of said compressor, and having a compressed air inlet passage opening into said air admission passage and a plurality of exhaust ports extending through said stationary member from said one end to the other and spaced along a circle around the central air admission passage; a rotary member having one end engaged against said one end of said stationary member and rotatable relative thereto about an axis of rotation concentric with said circle and having a connecting recess in said one end with one end on the axis of rotation and aligned with said central air admission passage and the other end on said circle for successively communicating said central air admission passage and said exhaust ports as said rotary member rotates, and at least one throttle hole substantially smaller in diameter than said exhaust ports extending through said rotary member from said one end to the other and lying on said circle and behind, relative to the direction of rotation of said rotary member, said connecting recess; a motor having a drive shaft; a rotary disk mounted on said drive shaft and in driving engagement with said rotary member; and a spring between said rotary disk and said rotary member urging said rotary member into engagement with said stationary member;

at least one bag means shaped for being wound directly around a part to be massaged, said bag means having a plurality of air tight sections which are expanded by the force of compressed air; and air delivering means connected between said exhaust ports of said distributing means and said bag means for delivering compressed air from the respective exhaust ports of said distributing means and the corresponding sections of said bag means, said air delivering means having no safety valve means.

2. A massager as claimed in claim 1 in which said delivering means comprises a plurality of pipes each having means for detachably connecting one end to a respective said exhaust port and the other end to a corresponding section of said bag means.

3. A massager as claimed in claim 2 further comprising means for conducting alternating current to said electromagnet means, and a timer connected in said current conducting means for controlling the period of time for which the current is supplied.

4. A massager as claimed in claim 1 further comprising means for conducting alternating current to said electromagnet means, and a timer connected in said current conducting means for controlling the period of time for which the current is supplied.

5. A massager as claimed in claim 1 further comprising a housing in which said controller is mounted and into which said intake part of said compression chamber opens, and a filter on said housing for passing air therethrough to said intake port.

6. A massager as claimed in claim 1 further comprising means for conducting an alternating current to said electromagnet means, and a diode connected in said current conducting means for subjecting the alternating current to half wave rectification.

* * * * *